US007340925B2

(12) United States Patent
Kim et al.

(10) Patent No.: US 7,340,925 B2
(45) Date of Patent: Mar. 11, 2008

(54) WASHING MACHINE

(75) Inventors: Jong Seok Kim, Changwon-si (KR); Yang Hwan No, Changwon-si (KR); Han Ki Cho, Changwon-si (KR); Yeon Su Jung, Changwon-si (KR); Jung Hoon Kang, Changwon-si (KR); Myung Sik Park, Changwon-si (KR); Young Hoon Ha, Masan-si (KR)

(73) Assignee: LG Electronics Inc., Seoul (KR)

( * ) Notice: Subject to any disclaimer, the term of this patent is extended or adjusted under 35 U.S.C. 154(b) by 455 days.

(21) Appl. No.: 10/722,459

(22) Filed: Nov. 28, 2003

(65) Prior Publication Data

US 2004/0154351 A1 Aug. 12, 2004

(30) Foreign Application Priority Data

Nov. 28, 2002 (KR) ..... P10-2002-0075028

(51) Int. Cl.
*D06F 37/20* (2006.01)

(52) U.S. Cl. ..... 68/23.1; 68/12.06; 68/12.02

(58) Field of Classification Search ..... 68/12.02, 68/12.06, 12.27, 12.24, 23.1
See application file for complete search history.

(56) References Cited

U.S. PATENT DOCUMENTS 3,227,835 A * 1/1966 Conrath ..... 200/61.45 R
4,098,098 A * 7/1978 Altnau ..... 68/23 R
5,183,056 A * 2/1993 Dalen et al. ..... 600/595
5,685,038 A * 11/1997 Smith et al. ..... 8/159

* cited by examiner

*Primary Examiner*—Michael Barr
*Assistant Examiner*—Jason P. Riggleman
(74) *Attorney, Agent, or Firm*—Birch, Stewart, Kolasch & Birch, LLP

(57) ABSTRACT

A washing machine having a vibration sensing assembly for sensing a transient vibration of a tub. The vibration sensing assembly includes a fixing part fixed to an inner wall of a cabinet, a rotational part rotatably connected to the fixing part to perform a rotational movement within a predetermined range by the vibration of a tub centering around a portion connected to the fixing part, and a sensor provided to the rotational part to sense the rotational movement of the rotational part.

18 Claims, 7 Drawing Sheets

WASHING MACHINE

This application claims the benefit of Korean Application(s) No. 10-2002-0075028 filed on Nov. 28, 2002 which is/are hereby incorporated by reference.

BACKGROUND OF THE INVENTION

1. Field of the Invention

The present invention relates to a washing machine, and more particularly, to a washing machine having an assembly for sensing a transient vibration of a tub.

2. Discussion of the Related Art

Generally, water and detergent are held in a tub of a drum type washing machine and a laundry is put in a drum inside the tub. The drum is then rotated to perform washing, rinsing, and dewatering.

FIG. 1 is a perspective view of a general drum type washing machine and FIG. 2 is a cross-sectional view of a general drum type washing machine.

Referring to FIG. 1 and FIG. 2, a general washing machine consists of a base 2, a cabinet body 4 provided on the base 2 to have an open front side, a tub 6 provided in the cabinet body 4 to hold water or detergent, a drum 8 rotatably provided in the tub 6, a motor 10 rotating the drum 8, a cabinet cover 32 provided to the front side of the cabinet body 4 to have a laundry entrance at a central part, a control panel 34 provided over the cabinet cover 32 to control the washing machine, a lower cover 36 provided under the cabinet cover 32, a top plate 38 provided over the cabinet cover 4, a gasket 40 provided between the tub 6 and the entrance, an inlet assembly 42 for supplying water or detergent to the tub, and a drain assembly 44 for discharging the used water in the tub 6 outside the washing machine.

The top and bottom of the tub 6 are supported by springs 6*a* and dampers 6*b* attenuating vibrations, respectively. The drum 8 holds water inside. A multitude of perforated holes 8*a* are formed at a circumference of the drum 8, and a plurality of lifts 8*b* lifting up the laundry to fall are installed on an inner circumference of the drum 8.

A door 32*a* that is revolvable is installed at the cabinet cover 32 to open/close the laundry entrance.

However, in the above-constituted general washing machine, the laundry inside the drum 8 is entangled while a washing, rinsing, or dewatering step is in progress. In such a case, a transient vibration appears on the tub 6 to hit an inside of the cabinet 4.

Hence, the washing machine makes noise, the cabinet 4 or the tub 6 may be broken, and the washing machine rocks right and left or back and forth.

To overcome such problems, many efforts are made to develop of a new washing machine having a vibration sensing assembly for preventing the transient vibration of the tub.

SUMMARY OF THE INVENTION

Accordingly, the present invention is directed to a washing machine having a vibration sensing assembly for sensing a transient vibration of a tub that substantially obviates one or more of the problems due to limitations and disadvantages of the related art.

An object of the present invention, which has been devised to solve the foregoing problem, lies in providing a washing machine having a vibration sensing assembly for sensing a transient vibration of a tub, by which shaking and noise, which may be caused by the transient vibration of the tub, of the washing machine is prevented.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine including a tub having an open front side, a drum rotatably provided in the tub to hold laundry, a motor rotating the drum, a cabinet having the tub and the motor inside, a control unit controlling a vibration of the tub, and a vibration sensing assembly for sensing the vibration of the tub.

The vibration sensing assembly includes a fixing part fixed to an inner wall of the cabinet, a rotational part rotatably connected to the fixing part to perform a rotational movement within a predetermined range by the vibration of the tub centering around a portion connected to the fixing part, and a sensor provided to the rotational part to sense the rotational movement of the rotational part.

The fixing part includes a fixing body fixed to the inner wall of the cabinet, a first rotational connecting portion connected in one body to the fixing body and rotatably connected to one side of the rotational part, and a first stopper provided to interrupt the rotational movement of the rotational part so that the rotational part performs the rotational movement within the predetermined range only.

The first rotational connecting portion includes an insertion hole in which a rotational center of the rotational part is inserted.

The fixing part preferably further includes a first elastic member returning the rotational part to an original position. In this case, the first elastic member includes a first coil spring having one end connected to the fixing body or the first stopper and the other end connected to the rotational part.

And, the fixing body is fixed to the inner wall of the cabinet by at least one hook.

The rotational part includes a second rotational connecting portion rotatably connected to the first rotational connecting portion of the fixing part to be a rotational center and a rotational body having one end connected to the second rotational connecting portion to rotate according to the vibration of the tub centering around the second rotational connecting portion.

The rotational body includes a vibration transferring portion provided to an opposite side of the second rotational connecting portion to transfer the vibration of the tub to the rotational body.

The rotational body includes a first rotational body having one side rotatably connected to the second rotational connecting portion and a second rotational body having one side connected to the other side of the first rotational body and the other side having the vibration transferring portion.

The first rotational body includes a second stopper having the second rotational body rotate within a predetermined range and a third rotational connecting portion to which one side of the second rotational body is rotatably connected.

Preferably, the first rotational body further includes a second elastic member returning the second rotational body to its original position.

The second elastic member includes a second coil spring having one end connected to the second stopper and the other end connected to the second rotational body.

The second rotational body includes a fourth rotational connecting portion connected to the third rotational connecting portion to become a rotational center and a sensor receiving portion receiving the sensor therein.

In this case, the sensor receiving portion is provided to an upper surface of the second rotational body.

The sensor includes a ball type rolling body moving in a reverse direction of a movement of the rotational body according to the vibration of the tub, a case providing a space for holding the rolling body, and a movement sensing unit for sensing a movement of the rolling body.

A vertical cross-section of the inner space of the case is circular or oval.

The movement sensing unit includes a signal transmitting part provided to one side of an inner wall of the case and a signal receiving part provided to the other side confronting the signal transmitting part to receive a signal transmitted from the signal transmitting part.

The vibration sensing assembly can be coupled to the inner wall of a rear side of the cabinet in rear of the tub.

Preferably, the tub includes a protruding plate provided in the vicinity of a lateral side of the rotational par, the protruding plate protruding in a rear direction to transfer a right-to-left vibration of the tub to the rotational part.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
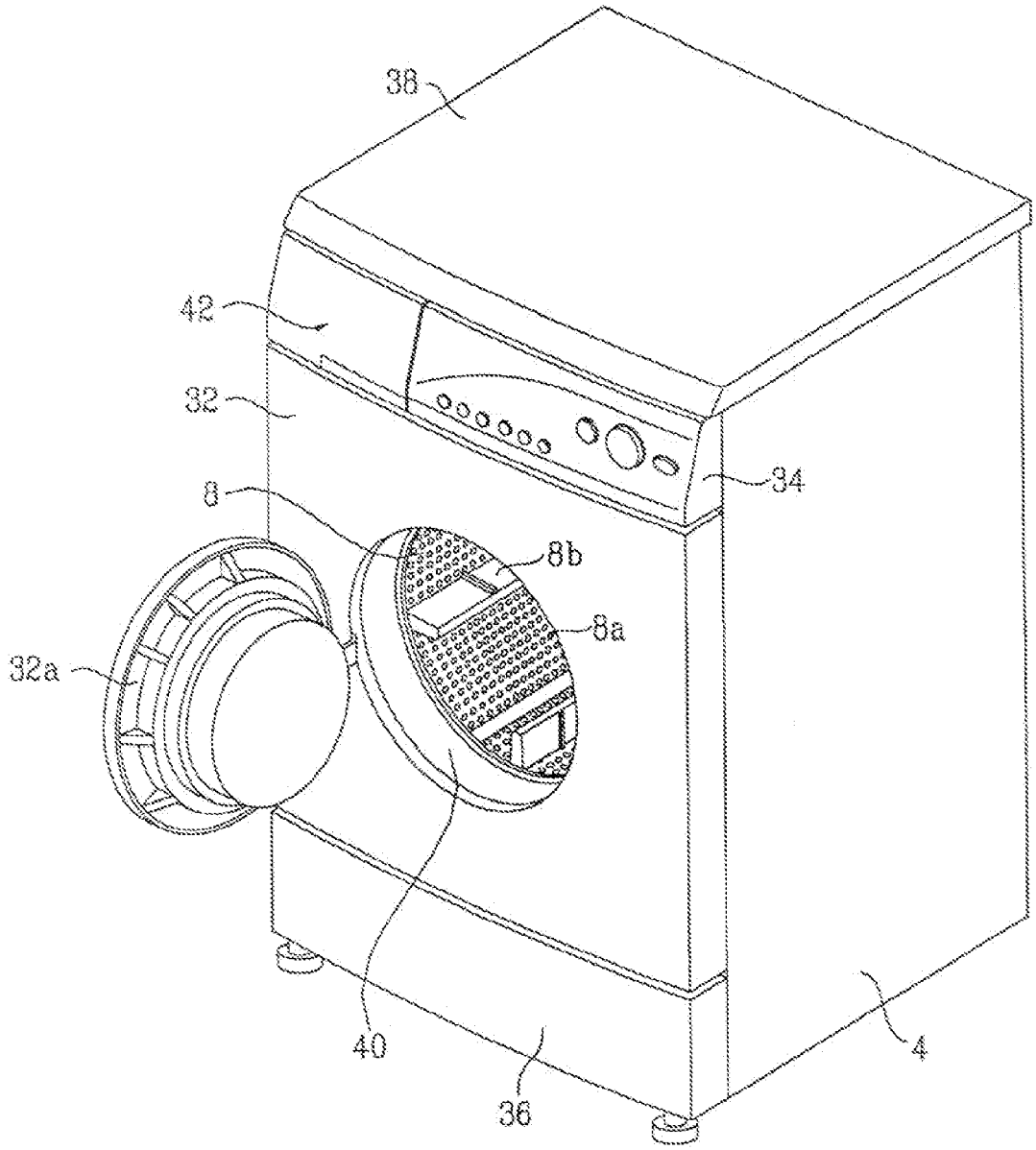
FIG. 1 PRIOR ART
FIG. 1 is a perspective view of a general drum type washing machine.
Figure 2:
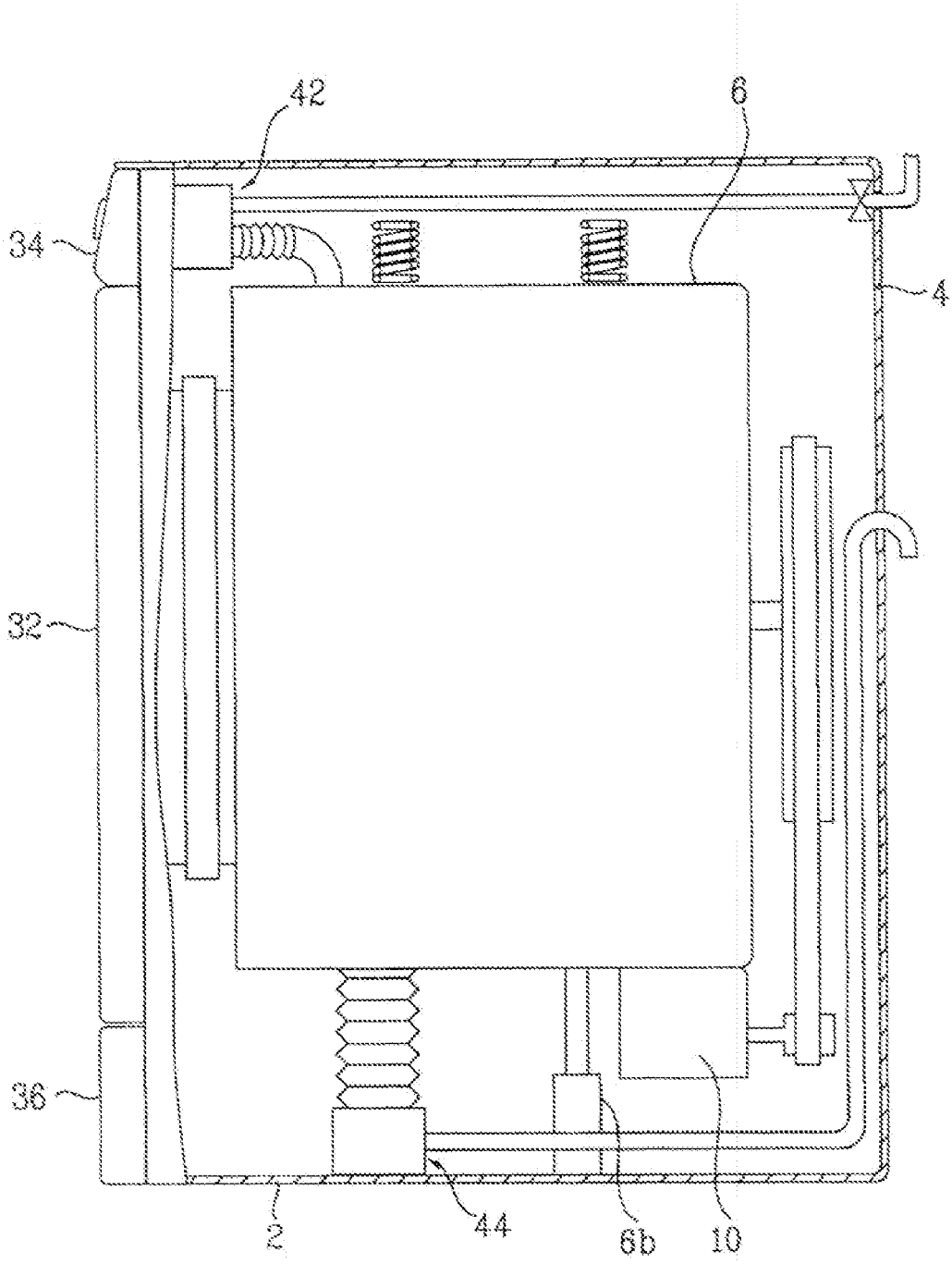
FIG. 2 PRIOR ART
FIG. 2 is a cross-sectional view of a general drum type washing machine.
Figure 3:
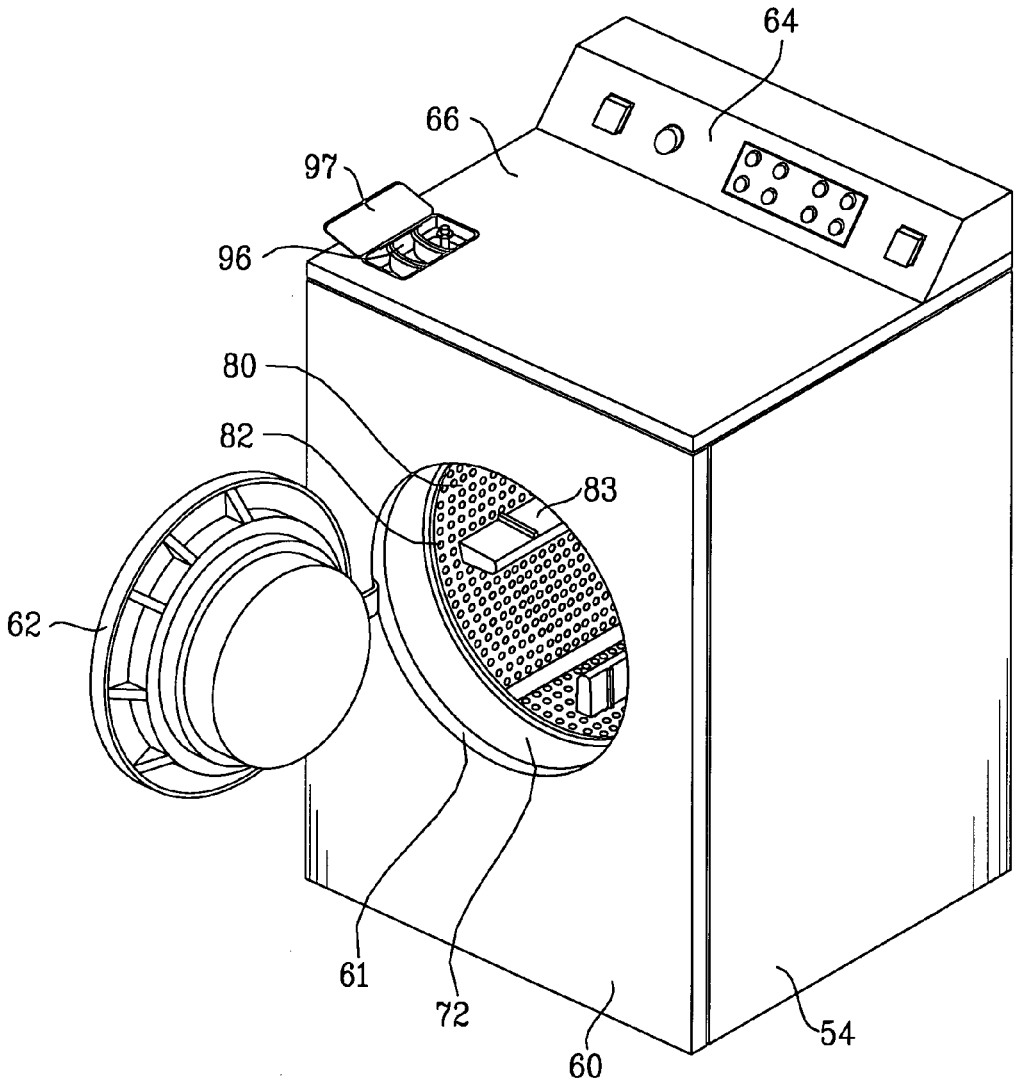
FIG. 3 is a perspective view of a drum type washing machine according to the present invention.
Figure 4:
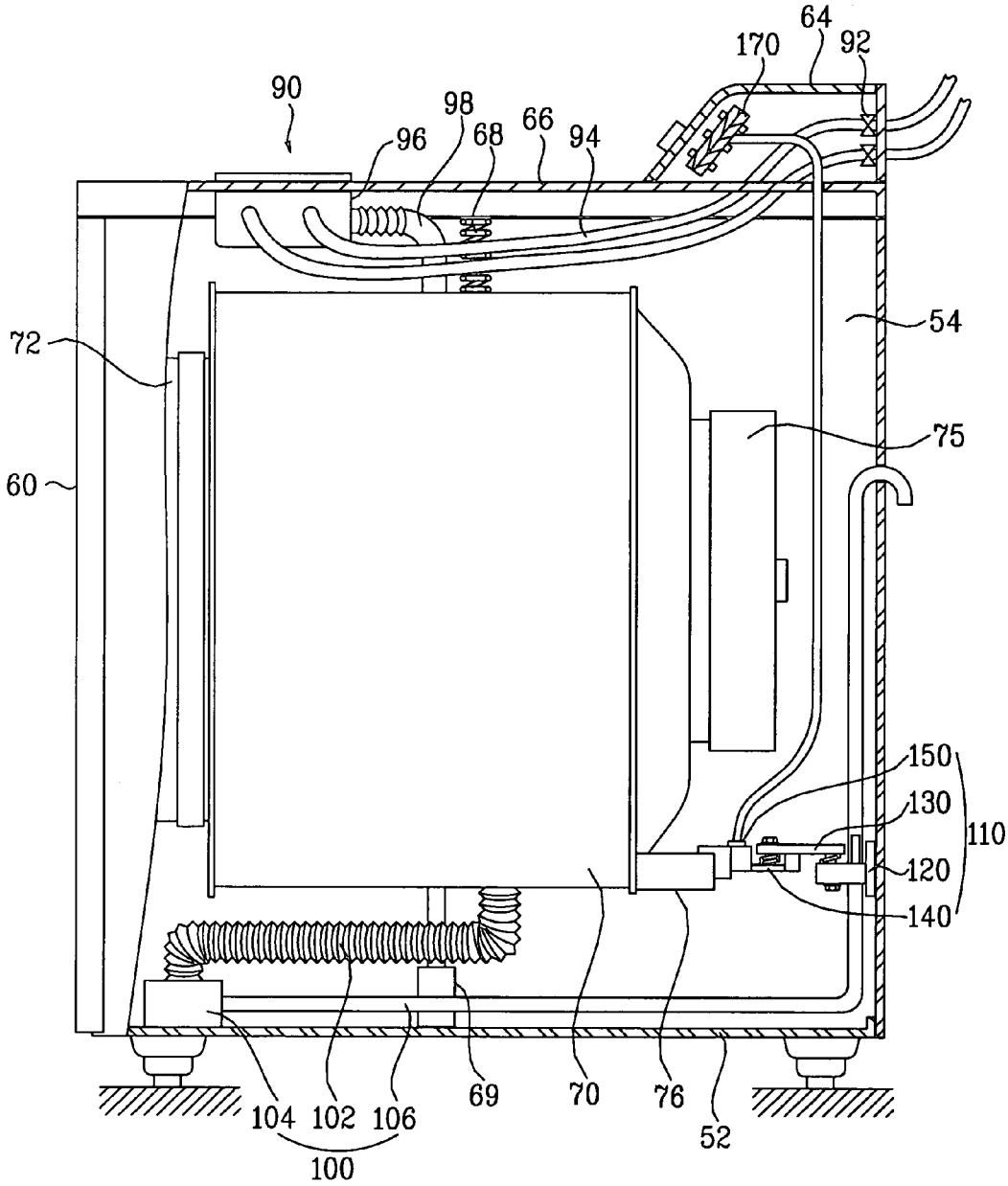
FIG. 4 is a cross-sectional view of a drum type washing machine according to the present invention.

FIG. 3 is a perspective view of a drum type washing machine according to the present invention and FIG. 4 is a cross-sectional view of a drum type washing machine according to the present invention.

Referring to FIG. 3 and FIG. 4, a washing machine according to the present invention includes a cabinet, a tub 70 provided in the cabinet to hold water and having an open front side, a drum 80 rotatably provided in the tub, a motor 75 in rear of the tub 70 to rotate the drum 80, a spring 68 provided over the tub 70 to attenuate a vibration of the tub 70, a damper 69 provided under the tub 70 to attenuate the vibration of the tub 70, an inlet assembly 90 supplying water or detergent to the tub 70, a drain assembly 100 discharging the water in the tub 70 outside the washing machine, a vibration sensing assembly 110 for sensing a transient vibration of the tub 70, and a control unit 170 controlling to drive the motor 75, inlet assembly 90, and drain assembly 100 and controlling to drive the motor 75 in case that the transient vibration of the tub 70 is sensed.

A multitude of perforated holes 82 are formed at the drum 80 to communicate with the tub 70, and a plurality of lifts 83 lifting up the laundry to fall are installed on an inner circumference of the drum 80.

The cabinet includes a base 52, a cabinet body 54 provided on both lateral sides and a rear side of the base 52, a cabinet cover 60 provided to a front side of the cabinet body 54, and a top plate 66 provided over the cabinet body 54.

A laundry entrance 61 is formed at a central part of the cabinet cover 60, and a door 62 is installed at the cabinet cover 60 to open/close the laundry entrance 61.

A gasket 72 is installed between the laundry entrance 61 and the tub 70 to prevent water leakage and laundry jamming on operating the washing machine.

A control panel 64 for controlling an operation of the washing machine is installed on a rear part of the top plate 66.

The inlet assembly 90 includes an inlet valve 92 provided in the top plate 66 to switch a water supply by the control unit 170, an inlet hose 94 guiding water flowing out of the inlet valve 92, a detergent box 96 mixing the water guided by the inlet hose 94 with a detergent to discharge, and an inlet bellows 98 leading the water or detergent discharged from the detergent box 96 to the tub 70. A cover 97 covers the detergent box 96.

The drain assembly 100 includes a drain bellows 102 guiding the water discharged from the tub 70, a drain pump 104 pumping the water guided by the drain bellows 102, and a drain hose 106 guiding the water pumped by the drain pump 104 outside.

And, the vibration sensing assembly 110 includes a fixing part 120 fixed to an inner wall of the cabinet body 54, a rotational part (not shown in the drawing) rotatably connected to the fixing part 120 to perform a rotational movement within a predetermined range by a vibration of the tub, and a sensor 150 provided to the rotational part to sense the rotational movement of the rotational part.

In this case, one end of the vibration sensing assembly 110 is fixed to an inner wall of a rear side of the cabinet in rear of the tub.

Figure 5:
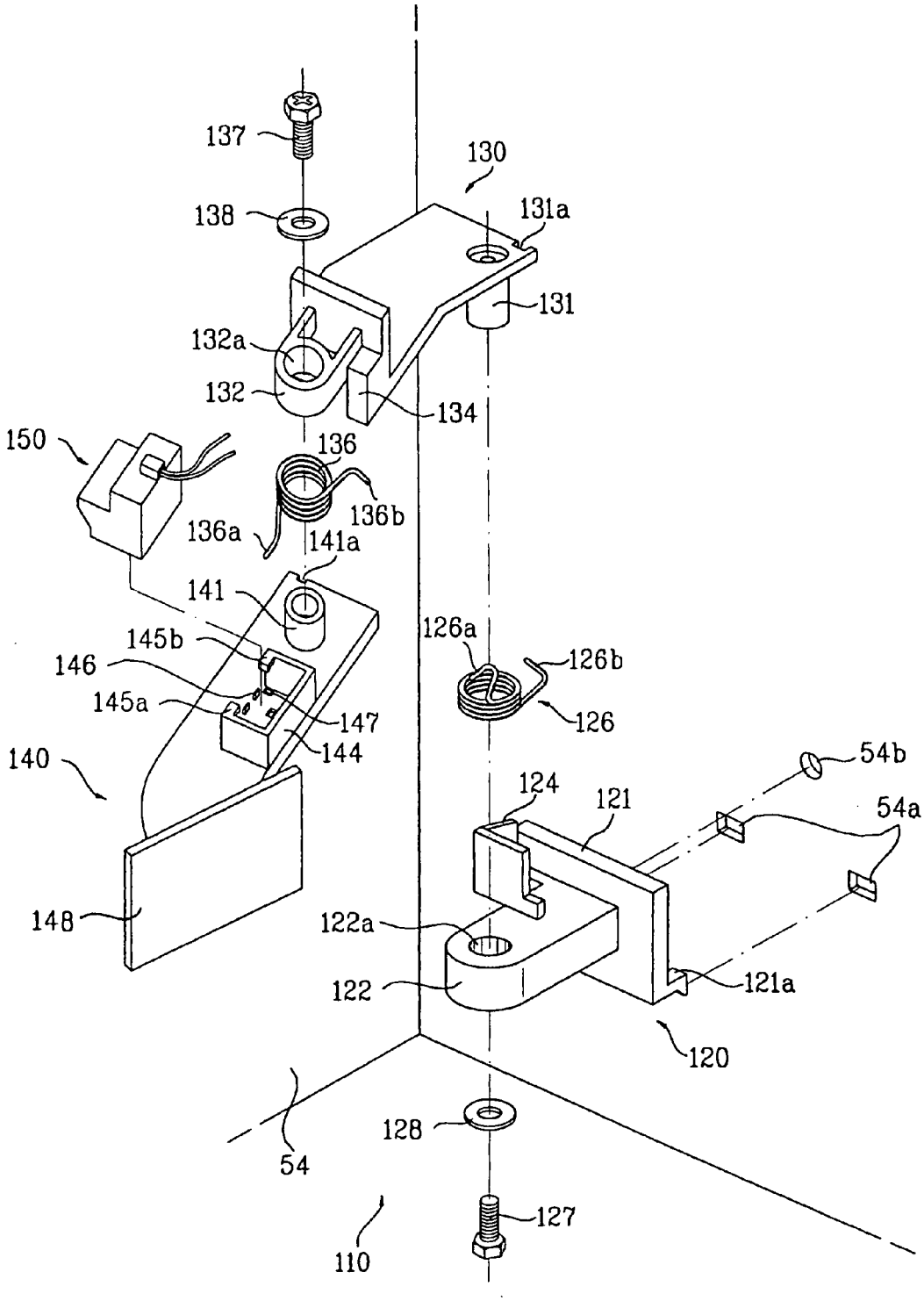
FIG. 5 is a perspective view of a disassembled vibration sensing assembly of a washing machine according to the present invention.

The fixing part 120, as shown in FIG. 5, includes a fixing body 121 fixed to the inner wall of the rear side of the cabinet, a first rotational connecting portion 122 rotatably connected to one side of the rotational part, and a first stopper 124 provided to interrupt the rotational movement of the rotational part so that the rotational part performs the rotational movement within the predetermined range only.

The first stopper 124 allows the rotational part to rotate only within the predetermined range by a front-to-rear vibration of the tub.

The fixing body 121 includes a rectangular panel. Hooks 121*a* protrude from both sides of a lower rear side of the fixing body 121, and hook holes 54*a* are formed at the rear side of the cabinet 54. Hence the hooks 121*a* are inserted in the hook holes 54*a*, respectively to fix the fixing body 121 to the cabinet body 54.

And, an upper part of the fixing body 121 is fixed by a locking member, e.g., screw, bolt, etc., penetrating a locking hole 54*b* formed at the cabinet.

An insertion hole 122*a* penetrating from an upper side to a lower side is formed at the first rotational connecting portion 122 so that a rotational center portion of the rotational part is inserted in the insertion hole 122*a* to rotate.

The rotational part includes a rotational body rotating according to the vibration of the tub 70 centering around a second rotational connecting portion 131 rotatably connected to the first rotational connecting portion of the fixing part 120.

The rotational body includes a vibration transferring portion provided to an opposite side of the second rotational connecting portion to transfer the vibration of the tub to the rotational body.

The rotational body includes a first rotational body 130 having one side rotatably connected to the fixing part 120 and a second rotational body 140 having one side connected to the other side of the first rotational body and the other side having the vibration transferring portion (not shown in the drawing).

The second rotational connecting portion 131 connected to the first rotational connecting portion 122 is provided to the one side of the first rotational body. In this case, the second rotational connecting portion 131 has a shape having an outside diameter smaller than an inside diameter of the insertion hole 122*a*.

Moreover, the first rotational body 130 includes a second stopper 134 having the second rotational body 140 rotate within a predetermined range only and a third rotational connecting portion 132 to which one side of the second rotational body 140 is rotatably connected.

In this case, the second stopper 134 is provided to rotate within a predetermined range by a right-to-left vibration of the tub 70.

The vibration transferring portion includes a side plate 148 transferring the right-to-left vibration of the tub.

Meanwhile, the second rotational body 140 includes a fourth rotational connecting portion 141 connected to the third rotational connecting portion 132 to become a rotational center and a sensor receiving portion receiving the sensor 150 therein.

In this case, the sensor receiving portion includes a receiving rib 144 protruding from an upper surface of the second rotational body 140 to have a cross-section of 'one side open rectangle'. Of course, the sensor receiving portion may be a recess formed at the upper surface of the second rotational body.

Hooks 145*a* and 145*b* are formed to confront each other on both sides of an upper end of the receiving rib 144 to fix the sensor 150.

A holding protrusion 146 fixing a lower end of the sensor to prevent the sensor 150 from being separated from the receiving rib 144 is formed at the second rotational body 140. And, a hook hole 147, in which a hook 159 (see FIG. 6) protruding from a bottom of the sensor 150 is inserted to be fixed thereto, is formed at the second rotational body 140.

The third rotational connecting portion 132 has an insertion hole 132*a* penetrating from an upper side to a lower side, and the fourth rotational connecting portion 141, which has a shaft shape having an outside diameter smaller than an inside diameter of the insertion hole 132*a*, is inserted in the insertion hole 132*a*.

The tub 70 protrudes in a rear direction to be provided in the vicinity of a side of the rotational part, and preferably includes a protruding plate 76 (see FIG. 4) transferring the right-to left vibration of the tub to the side plate 148.

Preferably, a first coil spring 126 is installed at a portion, where the first and second rotational connecting portions 122 and 131 are connected, to absorb a shock applied to the first rotational body 130 by the tub 70 and to return the rotated rotational part to be brought contact with the first stopper 124.

In this case, for installation of the first coil spring 126, one end 126*a* of the first coil spring 126 is fixed to a fixing recess 131*a* at the first rotational body 130, the other end 126*b* of the first coil spring 126 is connected to the first stopper 124 to be fixed thereto, and the second rotational connecting portion 131 is inserted in the first coil spring 126 in an axial direction.

A first bolt 127 is screwed in an inner circumference of the second rotational connecting portion 131 via the first rotational connecting portion 122. In this case, a first washer 128 is inserted between a head of the first bolt 127 and a bottom of the second rotational connecting portion 131 to prevent separation of the second rotational connecting portion. The first washer 128 has an outside diameter greater than an inside diameter of the first rotational connecting portion 122.

Moreover, a second coil spring 136 is installed at a portion, where the third and fourth rotational connecting portions 132 and 141 are connected, to absorb a shock applied to the second rotational body 140 when the tub 70 or the protruding plate 76 transfers the vibration to the second rotational body 140 and to return the rotated second rotational body 140 to its original position, i.e., to return the rotated second rotational body 140 to be brought contact with the second stopper 124.

In this case, for installation of the second coil spring 136, one end 136*a* of the second coil spring 136 is fixed to a hanging recess 141*a* at the second rotational body 130, the other end 136*b* of the second coil spring 136 is connected to the second stopper 134 to be fixed thereto, and the fourth rotational connecting portion 141 is inserted in the second coil spring 136 in an axial direction.

A second bolt 137 is screwed in an inner circumference of the fourth rotational connecting portion 141 via the third rotational connecting portion 132. In this case, a second washer 138 is provided between a head of the second bolt 137 and a top of the third rotational connecting portion 141 to prevent separation of the fourth rotational connecting portion.

Figure 6:
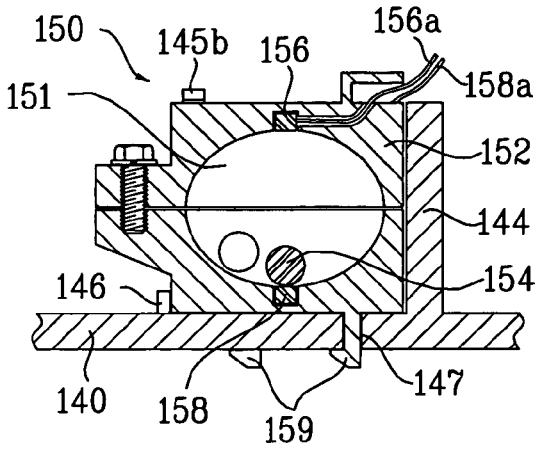
FIG. 6 is a cross-sectional view of a sensor provided to a washing machine according to the present invention.

Referring to FIG. 6, the sensor 150 includes a ball type rolling body 154 moving in a reverse direction of a movement of the rotational body according to the vibration of the tub, a case 152 providing a space 151 for holding the rolling body, and a movement sensing unit for sensing a movement of the rolling body 154.

A vertical cross-section of the inner space 151 of the case 152 is circular or oval.

The movement sensing unit includes a signal transmitting part 156 provided to one side of an inner wall of the case 152 and a signal receiving part 158 provided to the other side confronting the signal transmitting part to receive a signal transmitted from the signal transmitting part.

In the embodiment of the present invention, the signal transmitting part 156 is provided to a topside of the inner wall of the case and the signal receiving part 158 is provided to a bottom side of the inner wall of the case.

The rolling body 154, which normally lies over the signal receiving part 158, is unable to receive the signal transmitted from the signal transmitting part 156. Yet, the rolling body 154 deviates from the normal position, i.e., a position over the signal receiving part 158, in case of the transient vibration of the tub 70, the signal receiving part 158 enables to receive the signal transmitted from the signal transmitting part 156 to transfer the received signal to the control unit 170.

And, the signal transmitting and receiving parts 156 and 158 are connected to the control unit 170 via wires 156*a* and 158*a*, respectively.

An operation of the washing machine having the above-constructed vibration sensing assembly 110 is explained by referring to FIG. 7 to FIG. 9 as follows.

Figure 7:
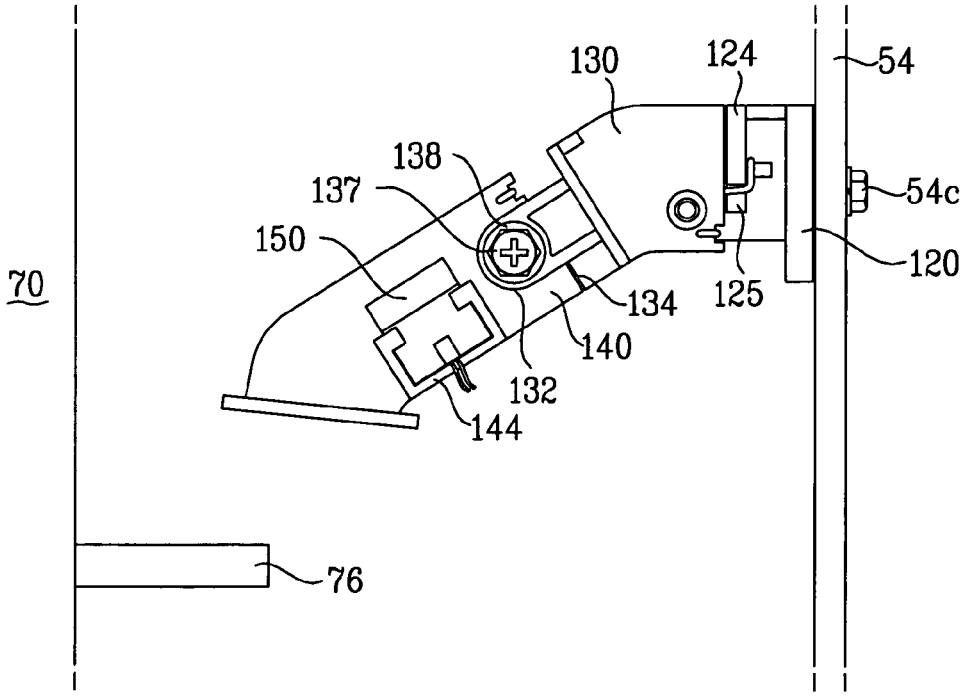
FIG. 7 is a side view of a vibration sensing assembly of a washing machine according to the present invention before a vibration is transferred from a tub.
Figure 8:
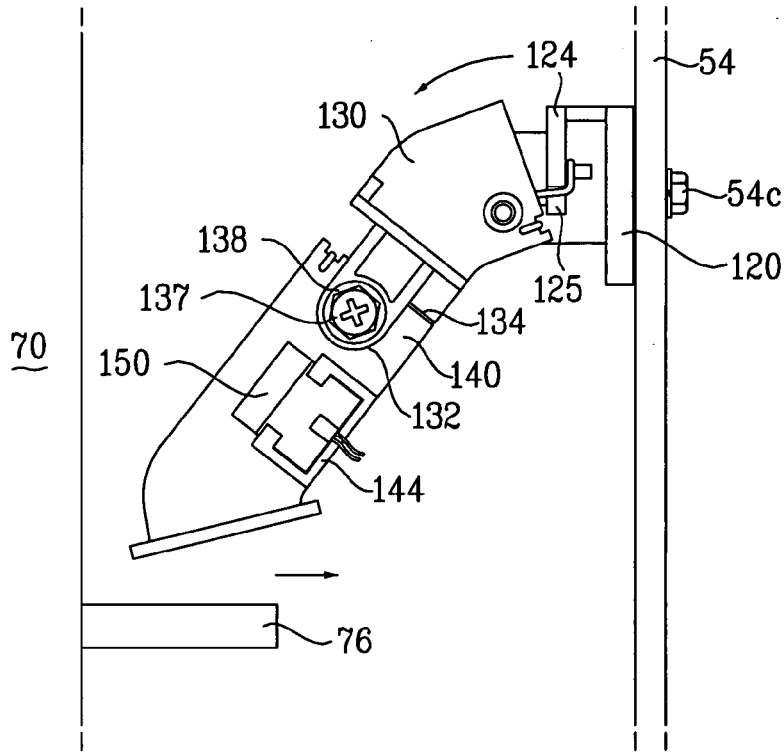
FIG. 8 is a side view of a vibration sensing assembly of a washing machine according to the present invention when front and rear vibrations are transferred from a tub.
Figure 9:
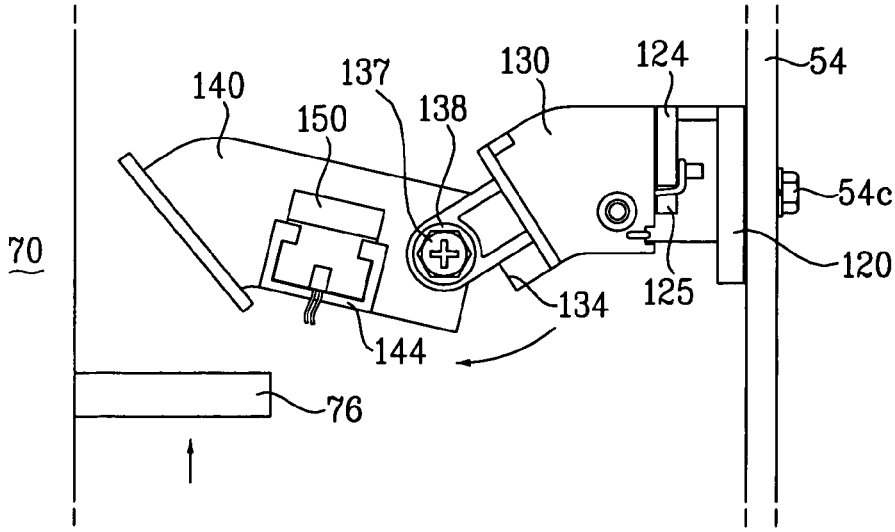
FIG. 9 is a side view of a vibration sensing assembly of a washing machine according to the present invention when right and left vibrations are transferred from a tub.

FIG. 7 is a side view of a vibration sensing assembly of a washing machine according to the present invention before a vibration is transferred from a tub, FIG. 8 is a side view of a vibration sensing assembly of a washing machine according to the present invention when front and rear vibrations are transferred from a tub, and FIG. 9 is a side view of a side view of a vibration sensing assembly of a washing machine according to the present invention when right and left vibrations are transferred from a tub.

First of all, a laundry is put in the drum 80 and the door 62 is then closed. Once the control panel 64 is operated to drive the washing machine, the detergent and water are supplied to the tub 70 from the inlet assembly 90.

The control unit 170 drives the motor 75 to rotate the drum 80, whereby the laundry is lifted up by the lifters 83 to fall for performing washing.

After completion of washing, the control unit 170 drives the drain pump 104 to discharge the used water is the tub 80 outside the washing machine via the drain hose 102.

After completion of draining, rinsing and dewatering are successively executed. In this case, the dewatering is performed for removing water contents involved in the laundry by rotating the drum 80 at high rotational speed.

The laundry may gather to be entangled in the drum 80 while the washing, rinsing, or dewatering is in progress, whereby the transient vibration appears on the tub 70.

Referring to FIG. 8, when the tub 70 generating the front-to-rear transient vibration applies a shock to the second rotational body 140, the second rotational body 140 pushes the second stopper 134 of the first rotational body 130, the first and second rotational bodies 130 and 140 rotate centering around the second rotational connecting portion 131, and the sensor 150 instantly senses the transient vibration of the tub 70.

Namely, when the case 152 moves together with the second rotational body the ball 154 deviates from its normal position according to inertia thereof. Hence, the signal receiving part 154 receives the signal transmitted from the transmitting part 156 to transfer it to the control unit 170.

The control unit 170 receives the signal transferred from the signal receiving part 154 to judge the transient vibration of the tub 70. If it is judged as the transient vibration, the control unit 75 stops driving the motor 75.

And, the respective rotational bodies 130 and 140 after such rotation and movement are returned to their original positions by the elastic force of the first coil spring 126.

Referring to FIG. 9, when right-to-left transient vibration of the tub 70 makes the protruding plate 76 applies a shock to the side plate 148 of the second rotational body 140, the second rotational body 140 rotates centering around the fourth rotational connecting portion 140 and the sensor 150 instantly senses the transient vibration of the tub 70.

In doing so, when the case 152 moves together with the second rotational body 140, the ball 154 deviates from its normal position according to inertia thereof. Hence, the signal receiving part 154 receives the signal transmitted from the transmitting part 156 to transfer it to the control unit 170.

The control unit 170 receives the signal transferred from the signal receiving part 154 to judge the transient vibration of the tub 70. If it is judged as the transient vibration, the control unit 75 stops driving the motor 75.

And, the second rotational body 140 after such rotation and movement are returned to its original position by the elastic force of the second coil spring 136.

Meanwhile, the washing machine may lie on its back or side for repair or transportation. In such a case, the first or second rotational body 130 or 140 is rotated by the tub 70, whereby the vibration sensing assembly 110 is prevented from being broken. When the washing machine is set upright, the first or second coil spring 126 or 136 returns the first or second rotational body 130 or 140 to its original position, thereby preventing malfunction of the vibration sensing assembly 110.

Accordingly, the present invention has the following advantages or effects as follows.

First of all, the present invention instantly senses the transient vibration of the tub of the washing machine, thereby enabling to prevent the transient vibration.

Secondly, the present invention prevents the noise or movement, which is caused by the transient vibration of the tub, of the washing machine.

Thirdly, even if the washing machine lies on its back or side for transportation or repair, the present invention prevents the breakage of the vibration sensing assembly.

Finally, the present invention facilitates to install the sensor at the receiving portion of the second rotational body.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine comprising:

a tub having an open front side;

a drum rotatably provided in the tub to hold laundry;

a motor rotating the drum;

a cabinet having the tub and the motor inside;

a control unit configured to control a vibration of the tub; and a vibration sensing assembly configured to sense the vibration of the tub, the vibration sensing assembly comprising:

a fixing part fixed to an inner wall of the cabinet;

a first rotational body having a first end connected to the fixing part and configured to rotate a first predetermined range with respect to the fixing part so as to restrict a front to rear vibration of the tub;

a second rotational body having a first end being moveable by a vibration of the tub and a second end connected rotatably to a second end of the first rotational body, said second rotational body configured to rotate a second predetermined range with respect to the first rotational body so as to restrict an up and down vibration of the tub; and a sensor configured to sense a rotational movement of at least one from the first and second rotational bodies.

2. The washing machine as claimed in claim 1, wherein the fixing part comprises:

a fixing body fixed to the inner wall of the cabinet, a first rotational connecting portion connected in one body to the fixing body and rotatably connected to the first end of the first rotational body, and a first stopper provided to interrupt the rotational movement of the first rotational body so that the first rotational body only rotates within the first predetermined range.

3. The washing machine as claimed in claim 2, wherein the first rotational connecting portion comprises an insertion hole in which a rotational center of the first rotational body is inserted.

4. The washing machine as claimed in claim 3, wherein the fixing part further comprises a first elastic member returning the first rotational body to an original position.

5. The washing machine as claimed in claim 4, wherein the first elastic member comprises a first coil spring having one end connected to the fixing body or the first stopper and the other end connected to the first rotational body.

6. The washing machine as claimed in claim 2, wherein the fixing body is fixed to the inner wall of the cabinet by at least one hook.

7. The washing machine as claimed in claim 2, wherein the first rotational body comprises:

a second rotational connecting portion rotatably connected to the first rotational connecting portion of the fixing part to be a rotational center; and a rotational body having one end connected to the second rotational connecting portion to rotate according to the vibration of the tub centering around the second rotational connecting portion.

8. The washing machine as claimed in claim 7, wherein the rotational body comprises a vibration transferring portion provided to an opposite side of the second rotational connecting portion to transfer the vibration of the tub to the rotational body.

9. The washing machine as claimed in claim 8, wherein the first rotational body further comprises:

a second stopper configured to interrupt the rotational movement of the second rotational body so that the second rotational body only rotates within the second predetermined range; and a third rotational connecting portion to which the second end of the second rotational body is rotatably connected.

10. The washing machine as claimed in claim 9, wherein the first rotational body further comprises a second elastic member returning the second rotational body to its original position.

11. The washing machine as claimed in claim 10, wherein the second elastic member comprises a second coil spring having one end connected to the second stopper and the other end connected to the second rotational body.

12. The washing machine as claimed in claim 11, wherein the second rotational body comprises:

a fourth rotational connecting portion connected to the third rotational connecting portion to become a rotational center; and a sensor receiving portion configured to receive the sensor therein.

13. The washing machine as claimed in claim 12, wherein the sensor receiving portion is provided to an upper surface of the second rotational body.

14. The washing machine as claimed in claim 1, wherein the sensor comprises:

a ball type rolling body moving in a reverse direction of a movement of the second rotational body according to the vibration of the tub;

a case providing a space for holding the rolling body; and a movement sensing unit configured to sense a movement of the rolling body.

15. The washing machine as claimed in claim 14, wherein a vertical cross-section of the inner space of the case is circular or oval.

16. The washing machine as claimed in claim 14, wherein the movement sensing unit comprises:

a signal transmitting part provided to one side of an inner wall of the case; and a signal receiving part provided to the other side confronting the signal transmitting part to receive a signal transmitted from the signal transmitting part.

17. The washing machine as claimed in claim 1, wherein the vibration sensing assembly is coupled to the inner wall of a rear side of the cabinet in rear of the tub.

18. The washing machine as claimed in claim 17, wherein the tub comprises:

a protruding plate provided in a vicinity of a lateral side of the rotational par, the protruding plate protruding in a rear direction to transfer a right-to-left vibration of the tub to the rotational part.

* * * * *